United States Patent [19]

Bakker

[11] Patent Number: 4,915,664

[45] Date of Patent: Apr. 10, 1990

[54] TOY GLIDER WITH WING CONVERGING MECHANISM

[76] Inventor: Erik Bakker, 60 Roycroft #39, Long Beach, Calif. 90701

[21] Appl. No.: 288,773

[22] Filed: Dec. 22, 1988

[51] Int. Cl.[4] ..... A63H 27/00; A63H 33/00

[52] U.S. Cl. ..... 446/62; 446/66; 446/487

[58] Field of Search ..... 446/34, 61, 62, 63, 446/64, 65, 66, 67, 68, 487

[56] References Cited

U.S. PATENT DOCUMENTS

| | | | |
|---|---|---|---|
| 152,250 | 6/1874 | Powers | 446/487 X |
| 2,059,131 | 10/1936 | McGall | 446/63 X |
| 2,306,866 | 12/1942 | Crary | 446/62 |
| 3,006,109 | 10/1961 | Boese | 446/34 |
| 3,369,319 | 2/1968 | Brown | 446/62 |
| 3,380,189 | 4/1968 | O'Millian | 446/62 |
| 3,408,767 | 11/1968 | Anderson | 446/62 |
| 3,496,671 | 2/1970 | Korona | 446/65 X |
| 3,654,729 | 4/1972 | Imperato | 446/62 |
| 3,839,818 | 10/1974 | Heggedal | 446/62 |
| 3,943,657 | 3/1976 | Leckie | 446/62 |

*Primary Examiner*—Robert A. Hafer
*Assistant Examiner*—D. Neal Muir
*Attorney, Agent, or Firm*—Howard A. Kenyon; Gunther Hanke

[57] ABSTRACT

A toy glider designed for launching with a slingshot like device, the glider having automatically converging wings for creating a swept-back appearance and for reducing air resistance during launch. The wings automatically rotate forward to an extended or glide configuration after launch. Wings are automatically converged by means of a sliding launching hook, which is pulled forward by the slingshot like launcher. When pulled forward, the launching hook slides forward within a longitudinal central aperture between the inboard portion of the wings, simultaneously rotating the inboard portions of the wings forward. This rotates the outlying wings into a swept-back or converged configuration. A rubber band tends to rotate the wing back into an extended or glide configuration, so when the force applied by the rubber band is greater than the forces opposing it, as when the plane slows, the wings are rotated out into an extended or glide configuration.

11 Claims, 4 Drawing Sheets

FIG. 3
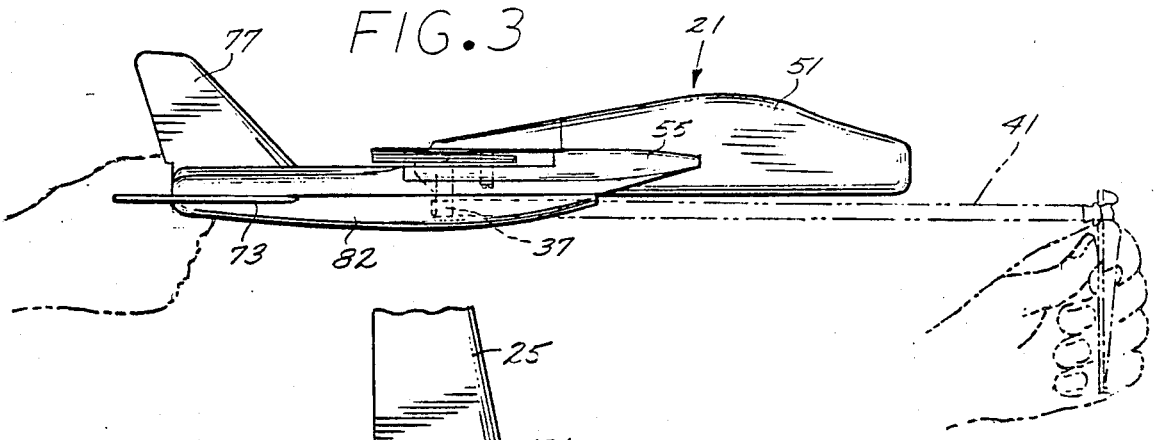
FIG. 4
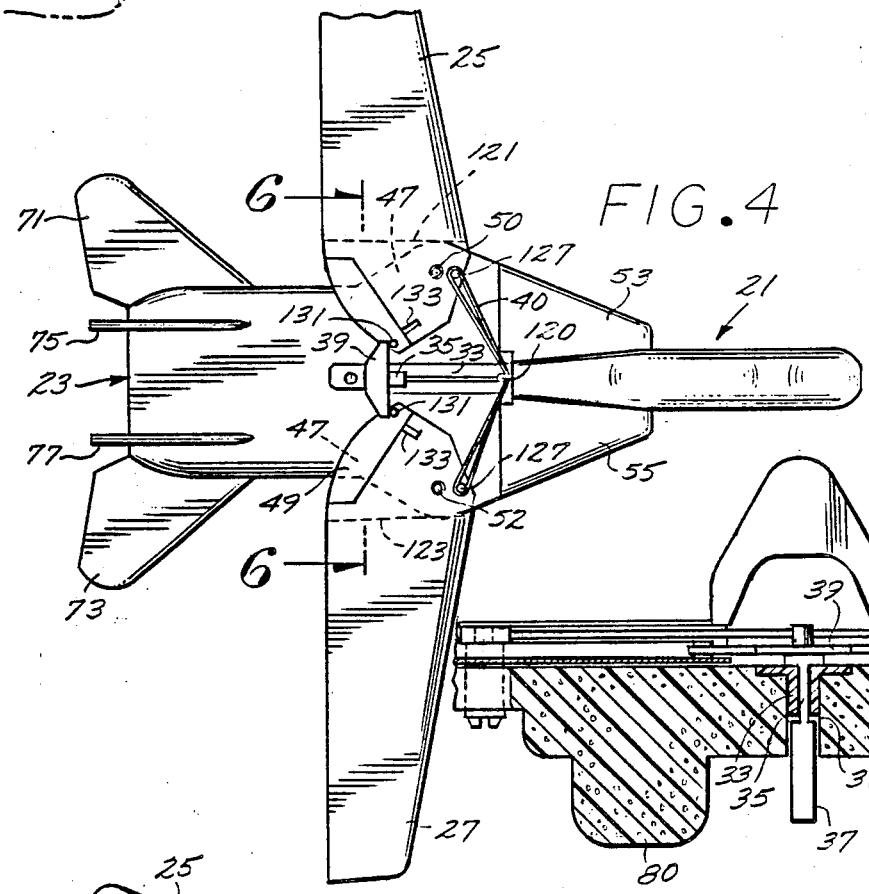
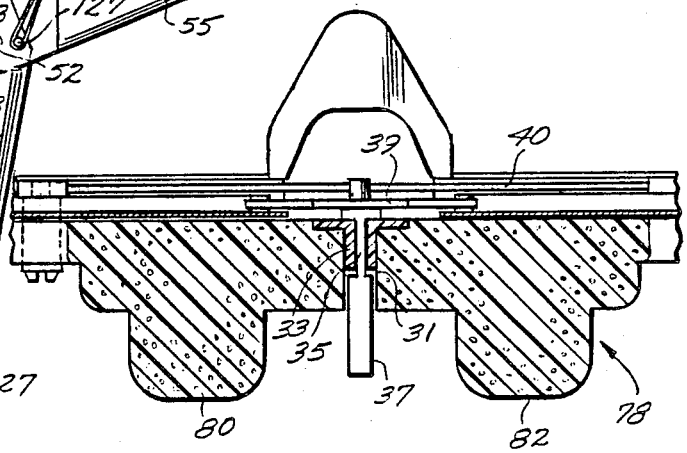
FIG. 6
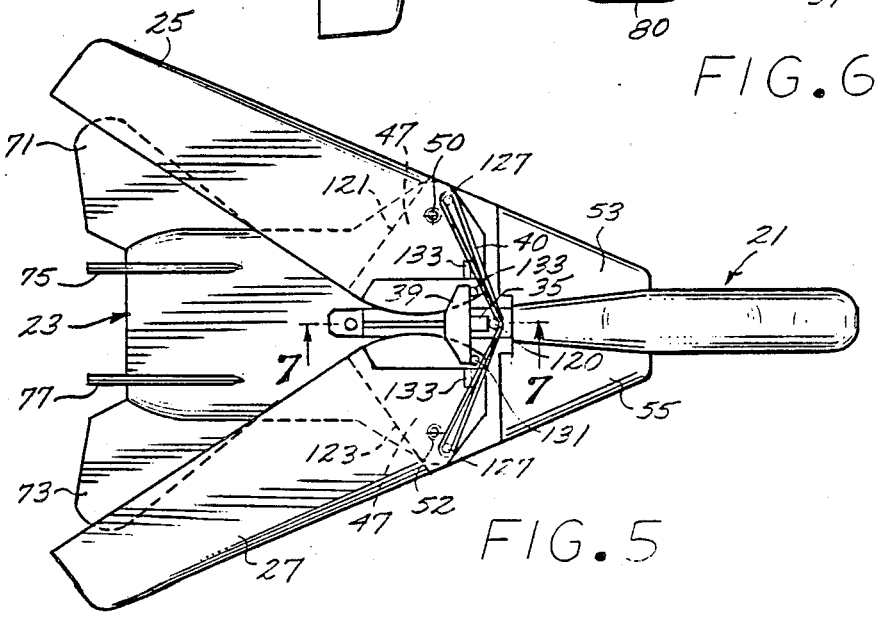
FIG. 5

TOY GLIDER WITH WING CONVERGING MECHANISM

BACKGROUND OF THE INVENTION

1.Field of the Invention

This invention relates to a model toy glider and more particularly to a glider adapted to be launched with a slingshot-like launcher which simultaneously actuates a mechanism causing the toy glider's wings to rotate into a swept-back or converged configuration.

2. Description of the Prior Art

The flying of toy gliders is an entertaining and educational activity participated in by numerous enthusiasts, both children and adults. Gently gliding a model airplane can be a source of joy and recreation especially where the toy mimics a full size airplane in appearance and function. One difficulty, however, has been to launch the toy glider from the ground to an altitude high enough to allow for an extended flight time. Another difficulty has been to imitate the wing rotation on the swing wing aircraft currently popular especially on wide fuselage aircraft.

Launching a glider at the high speeds necessary to attain altitude for an extended gentle flight is especially difficult due to the delicate wing structure and the relatively high wind resistance associated with toy airplanes built to glide at normal speeds. One method of launching is to use a slingshot like launcher. Depending on the power afforded by the launcher, high launch speeds and potentially high altitudes may thus be attained. Slingshot launched gliders are well known in the art, but none have solved the problem of providing a rugged and reliable glider which will overcome significant high wind resistance and deploy the delicate wing structure typical in a glider.

One solution to this problem has been to fold the wings back or converge the wings during launch. These wing configurations significantly reduce the wind resistance and streamline the craft for launch to a high altitude. In the past this has generally necessitated manually retracting the wings back and fastening them prior to launch. This is a process that could damage the wings, is inconvenient, and leaves the operator with the difficult task of handling the craft with the wings swept or folded back.

It is also desirable to delay deployment of the wings until after the craft has attained altitude. The means employed to do so in prior art, while undoubtedly appropriate for their intended use, had the disadvantage of incorporating mechanisms that were complex and did not faithfully mimic existing full-sized aircraft mechanisms in appearance or function.

One glider of prior art, U.S. Pat. No. 3,369,319 to Brown, shows a method of automatically retracting the wings by means of a rigid V-shaped spring which straddles the fuselage and is formed at its opposite extremities with legs which curve upwards and pierce into the rotatably mounted wings. When the spring is drawn forwardly relative to the fuselage by a launcher, the upward curved legs pull forwardly on the wings at a point inboard of the wing's rotational attachment to the fuselage, causing the wings to rotate into their converged position. This has the laudable effect of automatically retracting the wings without manual handling of the wings themselves.

Such a launch and glider mechanism, while acceptable for its intended purpose, suffers the shortcoming that it is not readily adaptable for use on wide body fuselage aircraft. Since swept-wing airplanes tend to be wide fuselage aircraft, such a device is not practical for use on toy gliders which faithfully mimic the appearance those aircraft.

In addition, such a mechanism requires a semirigid linkage between the launch spring and each wing, as well as a semirigid connection from one wing to another. This presents several possible hazards. For example, in the event that one of those elements is jammed or otherwise malfunctions, such a malfunction automatically disrupts the function of each of the other elements. If such a malfunction occurs during launch and prevents the wings from extending, the malfunction has the potential to destroy the toy since the altitude attainable by this type of launch is potentially in excess of sixty feet, and failure of the wings to deploy will most likely result in the craft diving destructively into the ground. Additionally, a blow during landing or flight to either of the wings or the launch spring will transmit the relevant force to the other connected components thus subjecting them to damage.

Additionally it is advantageous to have a biasing means separate from the launching spring for rotating the wings into their extended position. Thus if the launch spring is bent or otherwise damaged, the biasing means is not necessarily likewise destroyed. This invention further allows the use of a common rubber band as the biasing means, making manufacture and replacement of that component simple and inexpensive compared to rigid wire spring biasing means incorporated in the prior art.

Besides mimicking currently popular aircraft, the use of a solid, wide fuselage model has the additional advantage of allowing a launch hook to be protected from damage by protruding portions of that fuselage body.

SUMMARY OF THE INVENTION

The present invention provides a toy glider with an automatic wing converging mechanism which can be used on a solid wide bodied fuselage. The glider is designed to be launched by means of a slingshot-like launcher attached to a launch hook on the underside of the glider. When so launched, a launching mechanism attached to the launch hook automatically rotates the wings back into a converged position in the manner set forth in detail below.

Briefly, and in general terms, the glider is attached by means of its launching hook to the elastic band of a slingshot-like launcher. As that elastic band is stretched in preparation for launch, it pulls forward on the launching hook. That hook is on the underside of the glider's fuselage and is attached to a launch post which is slidably captive in a central slot in the fuselage. The launching post extends from the underside of the fuselage, through the central slot, to the upper side of the fuselage where it attaches to a transverse plate, which transverse plate in turn contacts the inboard trailing edge of each of the wings. The wings are attached to the fuselage by means of a pivot post at a location outboard of where the transverse plate contacts the trailing edge of the wing. Pulling the launching hook forward slides the launching post forward and thus simultaneously slides the transverse plate forward. The transverse plate pushes the inboard trailing edge of the wings forward. As the inboard trailing edge of the wings are pushed forward, the wings rotate around the pivot point into a converged position.

A biasing means, such as a rubber band, is attached from the leading edge of the wings to a position forward of the wings, tending to urge them into an extended position. It will be noted that as the wing rotates into a converged position, the moment tending to rotate the wing into an extended position decreases. This phenomenon will be discussed in greater detail below in the preferred embodiment of the invention. Suffice it to say here that as long as the forces tending to rotate the wings rearward are greater than the biasing force tending to rotate the wings into an extended position, the wings remain converged. Once the wings are extended, the pressure required to force them back into a converged position is increased. Thus the wings may be held rather forcefully in an extended position by the same biasing means that gently urges them into the fully extended position.

Immediately after the glider is launched skyward, the wings are converged and the glider is travelling at its most rapid rate. Thus the force of the air on the leading edges of the wings is greatest while the moment tending to rotate those wings forward into an extended configuration is at it least. As long as the air pressure on the leading edges of the wings is greater than the moment tending to rotate them into an extended position, they remain converged. As the glider nears its apex and slows, the air pressure on the leading edge of the wings is lessened, and the force afforded by the biasing means is sufficient to rotate the wings into an extended, or glide, configuration. The glider then begins its glide pattern. As set forth above, once the wings are extended, they have a relatively strong tendency to remain extended and resist being converged merely by a slight increase in force against their leading edge, as occurs with an increase in speed.

The biasing attachment, the rotation posts and the wing pivot posts contacted by the transverse plate may all be located on a rotation plate and not on the wing itself. The wing then snaps onto the rotation plate, and is affected exactly as set forth above, that is, it rotates into a converged configuration when the transverse plate is pulled forward against the wing rotation posts. Making the wings and the rotation plate separate structures has the advantage of allowing the wings and rotation plate to be made of separate material, such as soft, fragile and light foam sheeting for the wings, and hard, dense, sturdy and slippery injectable plastic for the rotation plates.

An adjustable cam at the rear of the central slot controls the degree that the slidable rod is allowed to travel rearward in the central slot, and thus controls the degree to which the converged wings are allowed to extend. The glide pattern may thus be preset and varied from flight to flight.

The entire mechanism is designed to snap together without the need of glue or similar permanent fastener material. This has the advantage of increasing the ease of assembly, as well as increasing the ease of disassembly for repair or replacement.

It is an object of this invention to provide an automatic wing converging mechanism for use on a wide bodied toy glider.

It is another object of this invention to provide an automatic wing converging means whereby such means is connected to the wings in a non-rigid manner so that a blow to one wing is not rigidly transmitted to another.

It is another object of this invention to provide an automatic wing converging means whereby the wing converging hook and the wing extending biasing means are separate structures.

It is another object of this invention to provide an automatic wing converging means on a slingshot launched glider whereby the slingshot like launcher actuates the wing converging mechanism.

It is another object of this invention to provide an adjustable wing extension limiter to control the glide configuration and thus the glide pattern of the toy glider.

It is another object of this invention to provide a wing converging mechanism for use on a toy glider which may be surrounded by the fuselage of the toy glider, thereby providing protection to that wing converging mechanism.

It is a further object of this invention to provide an automatic wing converging mechanism whereby the parts of said mechanism may be assembled and disassembled by snapping, unsnapping or other means not employing glue or other similar permanent fastener.

BRIEF DESCRIPTION OF THE DRAWINGS

FIG. 3 is a right side elevational view of the glider shown in FIG. 1 ;

FIG. 4 is a top plan view of the glider shown in FIG. 1 with wings in extended configuration and the protective cowling removed therefrom;

FIG. 5 is a top plan view of the glider shown in FIG. 1 with wings in converged configuration and the protective cowling removed therefrom;

FIG. 6 is a partial transverse sectional view, in enlarged scale, taken along the line of 6–6 of FIG. 4;

DESCRIPTION OF THE PREFERRED EMBODIMENT

Figure 8:
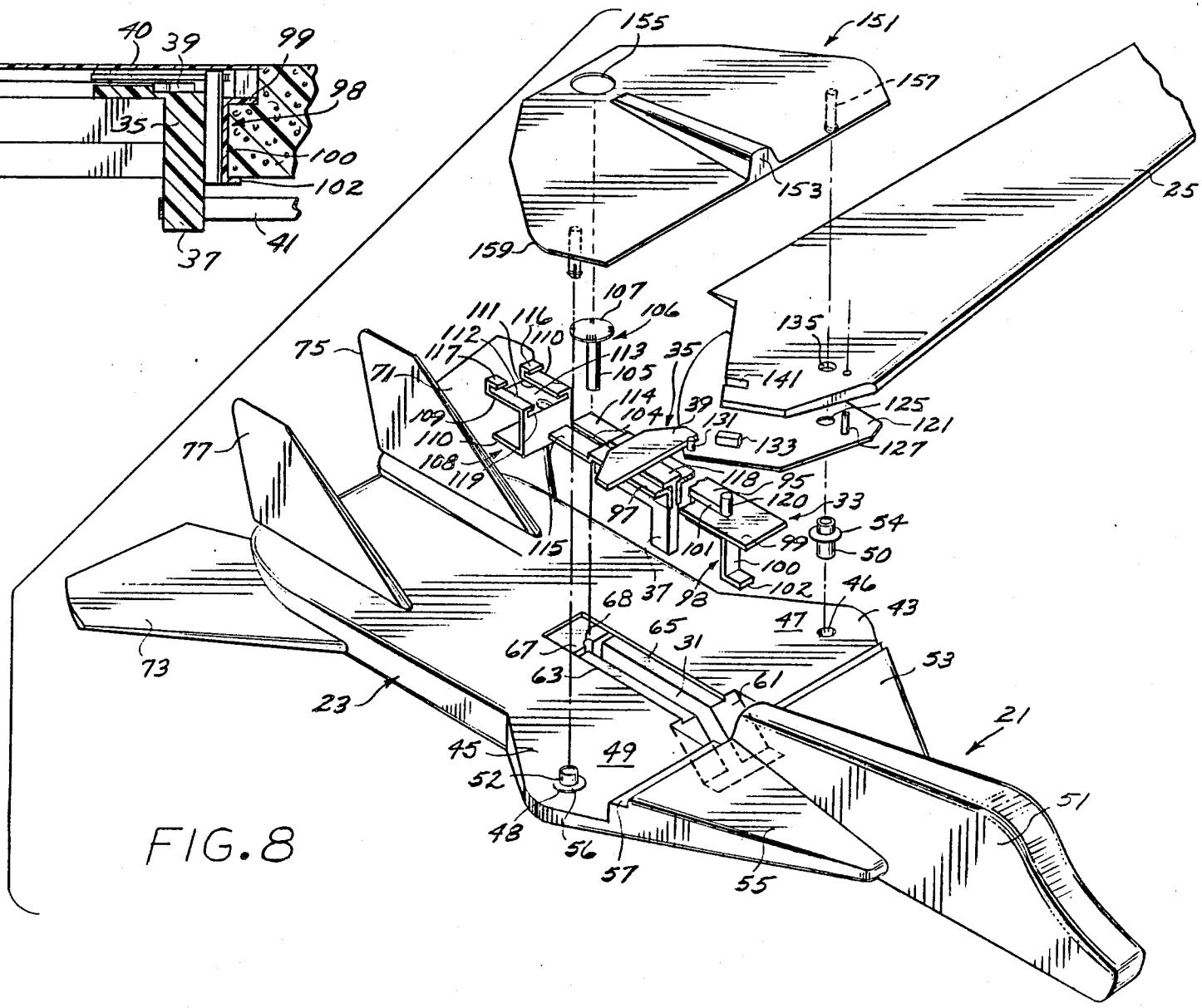
FIG. 8 is an exploded perspective view, in enlarged scale, (partly in cutaway), of the glider shown in FIG. 1.

The toy glider of the present invention includes, generally, a fuselage 21 having a wide body aft portion 23 with a pair of oppositely disposed retractable wings 25 and 27 mounted on the opposite sides thereof. Referring to FIGS. 4, 6 and 8, the fuselage is formed centrally with an elongated vertical through slot 31 which receives therein a track assembly 33 mounting a slider 35 for fore and aft travel therein. The slider 35 includes a downwardly depending launcher hook 37 and mounts at its upper extremity a laterally projecting drive plate 39 which engages the wings at its opposite extremities to, when driven forwardly, rotate the wings to their retracted positions shown in FIG. 2. The wings are biased to their extended position by means of a rubber band 40.

Figure 1:
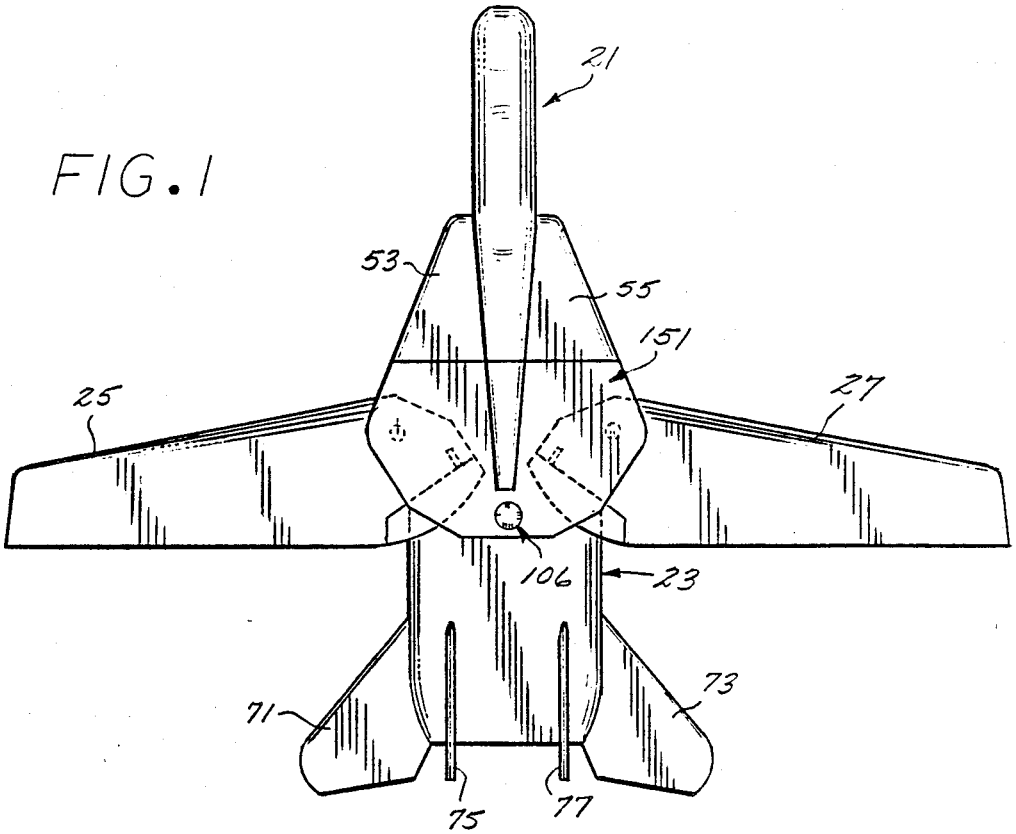
FIG. 1 is a top plan view of a toy glider embodying the invention with the wings in extended configuration.
Figure 2:
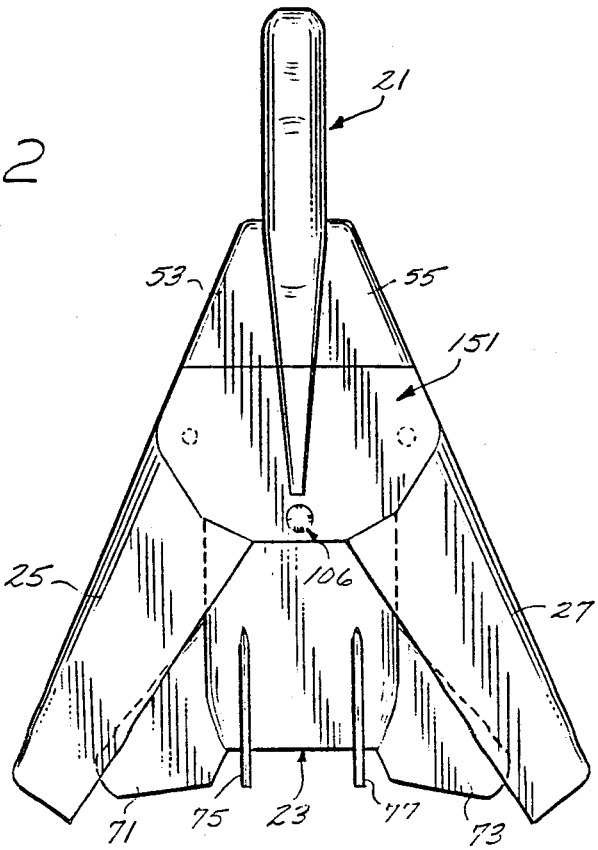
FIG. 2 is a top plan view of the toy glider shown in FIG. 1 with the wings in converged configuration.

Thus, by hooking a slingshot type launcher 41 (FIG. 3) on the hook 37 and actuating such launcher to drive the slider 35 forwardly in the track 33 the drive plate 39 will rotate the wings as viewed in FIG. 1 to their retracted positions shown in FIG. 2. Upon release the glider will be driven aloft with forces due to air flow across the wings holding them retracted. As the glider reaches the apex of its flight, the forces across the wings will be reduced to such an extent that the rubber band 40 will overcome such forces thus rotating the wings forward to their extended position shown in FIGS. 1 and 4.

The wide body 23 is of generally planar construction and is so configured as to closely imitate the configuration of a high performance fighter plane. The fuselage 21 may be constructed of a lightweight shapeable material such as expanded polystyrene. The wide body 23 is formed midship along its lateral opposite sides with outwardly protruding projections 43 and 45 (FIG. 8) which form on their upper sides respective support surfaces 47 and 49 over which the inboard extremities of the respective wings 25 and 27 are supported. The forward section of the fuselage is formed to simulate a cockpit 51 and then tapers rearwardly and outwardly therefrom to form oppositely disposed fairing sections 53 and 55 and is then formed with an upwardly facing laterally projecting step 57, the purpose of which will be set forth hereinafter.

The fuselage is then formed at the rearward extremity of the wide body portion 23 with oppositely disposed horizontal stabilizers 71 and 73 and incorporates respective vertical stabilizers 75 and 77 disposed therebetween. Referring to FIG. 6, the preferred embodiment incorporates a formed plastic foam undercarriage, generally designated 78, formed with laterally spaced apart longitudinal runners defining pontoons 80 and 82 which flank and project downwardly beyond the horizontal plane of the lower extent of the launch hook 37.

Referring to FIG. 8, the slot 31 is formed in its forward extremity with a laterally projecting, enlarged in cross section pocket 61 and projects rearwardly therefrom to be formed on its upper opposite sides with respective elongated upwardly facing recesses defining shoulders 63 and 65 onto which the support sections of the track 33 may nest. The slot is formed in its rearward extremity with a vertical semi-cylindrical bore 67 and a rearwardly projecting shelf 68.

Formed in the outwardly protruding wing support projections 43 and 45 are vertical through bores 46 and 48 which receive therein respective tubular journals 50 and 52. The respective journals 50 and 52 have mounted centrally thereon washers defining respective demarcation disks 54 and 56 on the exterior thereof.

Figure 7:
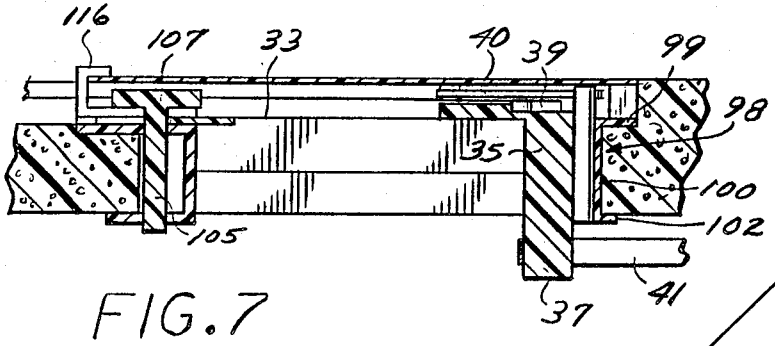
FIG. 7 is a partial longitudinal sectional view, in enlarged scale, taken along the line of 7–7 of FIG. 5.

Referring to FIGS. 7 and 8, the track 33 is constructed from a pair of small longitudinally extending angles forming rails 95 and 97 spaced apart to form therebetween an elongated slot 101 for receipt of the slider 35.

The rails 95, 97 are connected together at their forward extremity by means of a C-shaped mounting bracket, generally designated 98. The bracket 98 is formed with a forwardly extending mounting flange 99, downwardly projecting leg 100 and forwardly projecting flange 102. The flange 102 is spaced below the underside of the rails 95 and 97 a distance corresponding to the distance from the extended horizontal plane of the shoulders 63 and 65 to the underside of the fuselage such that the bracket will serve to trap the fuselage between such flange 102 and underside of the rails at the forward extremity of the slot 31 to thereby act as a mounting bracket.

The rails 95, 97 are formed at the rearward extremities with confronting semi-circular cutouts 104 for receipt therein of the stem 105 of an adjustment cam, generally designated 106. The adjustment cam mounts at the top extremity thereof an eccentric cam plate 107 which has indices marked on the top thereof to indicate the setting of the cam and consequent limitation on rearward travel of the drive plate 39 as to be discussed hereinafter. The lower extremity of the stem 105 projects below the lower extent of the fuselage to be gripped by the fingers of the operator for adjustment purposes.

The rear extremities of the rails 95 and 97 are somewhat resilient and the vertical flanges are removed therefrom at the rear extremities to form respective tongues 114 and 115 for receipt in a mounting bracket, generally designated 108. Such mounting bracket 108 is of generally C-shaped channel construction and is formed with rearwardly extending, vertically spaced apart top and bottom flanges 109 and 110 which are spaced vertically apart a distance sufficient to accommodate the thickness of the fuselage at the aft extremity of the slot 31. The bracket 108 is formed in the top flange with a fork defining a pair of laterally spaced apart tines which act as holding lips 111 and 112. Such lips form therebetween a space 113 for receipt downwardly therethrough of the tongues 114 and 115 when flexed slightly together. Formed in the front wall of such bracket 108 is a lateral slot sized and located so as to receive therein the tongues 114 and 115 such that when released they will flex laterally outwardly to thus be snapped to and retained in the cavity 119.

The rearward extremities of the tines 111 and 112 are turned upwardly and back on themselves to form forwardly opening hooks 116 and 117, the purpose of which will be set forth hereinafter.

The slider 35 includes a T-shaped slider fitting 118 having its vertical leg received in the track passage 101 and mounting on the lower extremity thereof the launcher hook 37. Mounted on top of the fitting 118 is the laterally projecting drive plate 39.

Referring to FIG. 4, interposed between the upwardly facing wing support surfaces 47 and 49 and the overlying inboard wing extremities are respective rotation plates, generally designated 121 and 123, the left hand rotation plate 121 being shown in detail in FIG. 8. The rotation plates 121 and 123 are mirror images of one another so the details of only plate 121 will be set forth herein. The plate 121 is generally planar and formed with a peripheral outline complementing the outline of the inboard end of the left hand wing 25. The plate 121 is formed with a through bore 125 sized to fit over the upper extremity of the journal 50. Disposed forwardly thereof on the plate 121 is an upstanding actuating post 127. Disposed rearwardly and inboard of the through bore 125 is an upstanding drive pin 131 and mounted on the top of such plate outboard and forward thereof is a rectangular tang 133.

The inboard extremity of the wing 25 is then formed with a pivot bore 135 for alignment over the bore 125 and is likewise sized to be fit over the top end of the journal 50. The wing 25 is formed at its inner end with angular surfaces, one such surface angling rearwardly and outwardly and having formed therein a rearwardly opening slot 141 configured to be complementally and functionally received over the tang 133.

Referring to FIG. 8, a protective cowling, generally designated 151, in the form of a truncated triangular shape, is provided for overlying the track assembly 33 and inboard portion of the wings 25 and 27. The cowling 151 may be constructed of lightweight plastic and is formed centrally with an upraised forwardly opening channel 153 shaped and configured to complementally mate with the exterior configuration of the rearward extremity of the cockpit 51 thus simulating a rearward extension thereof. The cowling 151 has mounted in depending relationship on the outboard edges thereof downwardly opening fastener pins 157 and 159 which are formed and configured for receipt and locking in the respective journals 50 and 52. The forward edge of the cowling 151 is formed with a straight edge for complemental receipt on the step 57 of the rearward extremity of the fairings 53 and 55 and the rearward edge thereof is configured for complemental receipt under the forwardly opening hooks 116 and 117 of the mounting bracket 108. Found centrally at the rear of such cowling is a circular window 155 overlying the cam plate 10 for viewing of the indices thereon.

From the above it will be appreciated that the toy glider of the present invention can be easily fabricated and constructed. The fuselage 21, including the wide body portion 23, may easily be formed by injection molding or the like. The track mechanism 33 may be constructed separately with the slider 35 installed therein by sliding it into the track passage 101 from the rearward extremity thereof.

The track mechanism 33 may then be easily mounted in the slot 31 by inserting the bracket 108 into the aft end of the slot 31 with the flange 109 nested on the shelf 68 and the bottom flange 110 thereof received under the fuselage. The track assembly 33 may then be inserted downwardly and forwardly into the slot 31 to position the forward bracket 98 in the pocket 61 such that the depth of the fuselage forward of such pocket may be received complementally in the space between the lower flange 102 and underside of the horizontal flange of the rails 95 and 97, (FIG. 8).

The horizontal flanges 95 and 97 of such track mechanism will then be nested in the shoulders 63 and 65 formed along the opposite sides of the slot 31. The rearward tongues 114 and 115 (FIG. 8) of such track may then be pressed laterally inwardly toward one another to clear the retaining lips 111 and 112 of the bracket 108 such that the rearward extremity of such track assembly may be lowered through the space 113 between the confronting edges of such lips and the tongues 114 and 115 then released to permit them to spring laterally outwardly to be locked in position. The cam stem 105 may then be inserted into the aperture 104 formed at the rearward extremity of the rails 95 and 97 to act as a spacer thereby locking the rails spaced outwardly beneath the flange lips 111 and 112 to thereby lock the track mechanism in position.

The forward edge of the cam plate 107 obstructs the rearward travel of the slider 35 in the elongated slot 101. Since the cam plate 107 is eccentrically mounted atop the cam stem 105, rotation of the cam stem 105 will vary the position at which the cam plate 107 obstructs the slot 101 and thus adjustably controls the rearward travel of the slider 35. This in turn controls the rearward travel of the drive plate 39 and thus the glide configuration of the wings 25, 27.

The rotation plates 121 and 123 may then be moved into position on the support surfaces 47 and 49 with the respective pivot bores 125 received over the upper extremity of the respective journals 50 and 52. The respective left and right hand wings 25 and 27 may then be moved into position over such rotation plates 121 and 123 for receipt of the pivot pins through the respective bores 135 and tangs 133 in the complemental slots 141. It will be appreciated that the fit of the bores 135 onto the respective pivot journals 50 and 52 and of the slots 141 on the tangs 133 serve to functionally hold the wing to the fuselage. A rubber band 40 may then be stretched to hook the opposite ends thereof over the respective actuating posts 127 with the central portion thereof stretched to be hooked in front of the anchor post 120. The cowling 151 may then be moved into position to snap the respective fastening pins 157 and 159 into the respective journals 50 and 52.

In operation, when it is desirable to launch the toy glider of the present invention, the user may conveniently grasp the handle of the launcher 41 in his left hand, hook the elastic band of the launcher over the downwardly projecting launch hook 37 and then grasp the aft end of the fuselage in his right hand as shown in FIG. 3 and direct the glider upwardly at the attitude desired for the particular flight path. As the operator's hands are drawn apart causing the launcher band to stretch and apply forwardly directed force onto the launcher hook 37, the slider 35 is carried forwardly in the track passage 101 causing the drive plate 39 to be drawn forwardly thus causing the opposite ends thereof to push forwardly on the respective drive pins 131. Such forwardly acting force tends to rotate the rotation plates 121 about the respective journal posts 50 and 52 causing the respective wings 25 and 27 surmounted thereon to likewise be rotated about such pivot pins thereby overcoming the bias of the rubber band 40 and causing the wings to be urged to their retracted positions shown in FIGS. 2 and 5. It will be appreciated by those skilled in the art that as the wings are rotated towards a swept back configuration about the respective journals 50 and 52, the effective moment arm through which the rubber band 40 acts becomes shorter thereby decreasing the force applied to the wings tending to rotate them to their extended positions. This characteristic is advantageous in that the magnitude of the force required to maintain the wings in their retracted position is thereby diminished.

Once the user releases his grip on the fuselage, the glider is propelled forwardly under influence of the launcher to direct it in its upward flight path. As the glider approaches the apex of its glide path, its speed will progressively slow until such time as the forces tending to hold the wings in their swept back position is reduced to such a point that the force applied by the rubber band 40 is sufficient to overcome such forces thus causing the wings to rotate about the respective journals 50 and 52 thereby rotating the wings to their extended positions shown in FIGS. 1 and 4.

It will be appreciated that during flight, with the wings 25 and 27 deployed to their extended positions shown in FIG. 4, any tendency of one or the other wing to be forcibly rotated to its retracted position is independent of the position of the opposite wing. Thus, should one or the other of the wings encounter a stationary object during flight tending to rotate that wing rearwardly, such wing is free to rotate rearwardly to the extent permitted by the bias of the rubber band 40, that is drive pin 131 associated with the wing so retracted will merely orbit forwardly relative to the drive plate 39 irrespective of the positioning of the opposing wing.

Figures 9, 10, 11, 12:
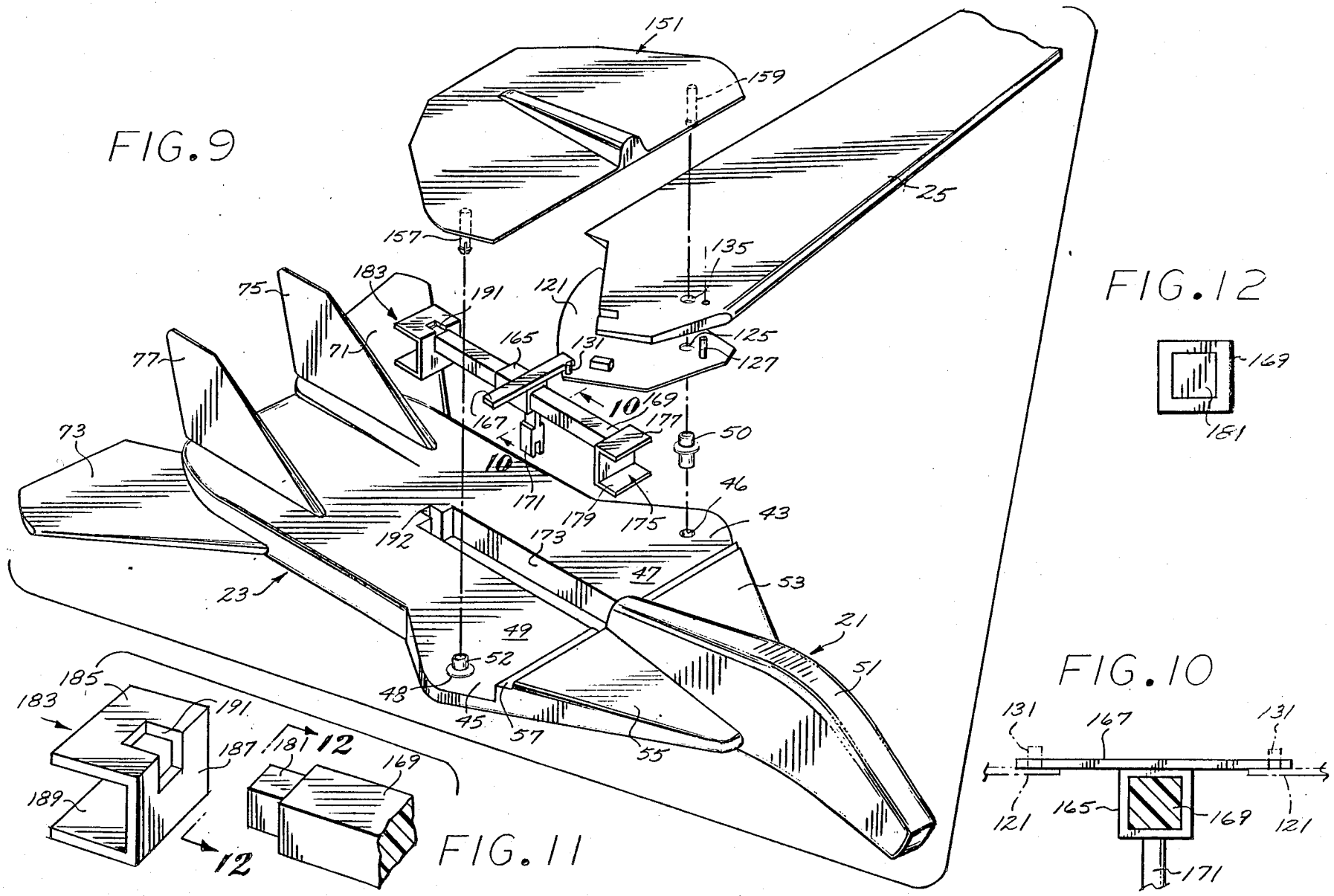
FIG. 9 is an exploded perspective view of a second embodiment of the toy glider of the present invention.
FIG. 10 is a partial transverse sectional view, in enlarged scale, taken along the line of 10—10 in FIG. 9.
FIG. 11 is an exploded perspective view, in enlarged scale of the rear C-shaped clamp and the rear portion of the elongated bar of the embodiment shown in FIG. 9.
FIG. 12 is an end view, in enlarged scale of the rear end of the transverse rod.

A second embodiment of the toy glider of the invention as shown in FIG. 9 incorporates a fuselage having a central slot 173 formed at its back wall with an upwardly opening clearance notch 192. In this embodiment, the slider is in the form of an open ended, box-like sleeve 165 received telescopically on a longitudinally extending rectangular track 169. Mounted on the top wall of the sleeve 165 above the fuselage and interposed between the rotation plates 121 is the drive plate 167. Depending from the lower surface of the sleeve 165 is the launching hook 171. When the launching hook 171 is pulled forwardly by the launcher 41, the sleeve 165 is pulled forwardly and likewise the drive plate 167, applying forward pressure on drive pins 131 to rotate the wings toward their swept back position in the manner described above.

The longitudinal track 169 is mounted at its forward and rearward ends from respective forward and rearwardly facing C-shaped clamps, generally designated 175 and 183. That clamp 175 is formed with an upper flange 177 and a lower flange 179 spaced apart sufficient to allow such clamp 175, when inserted in the forward end of the central slot 173, to receive the depth of the fuselage therein and thereby secure the forward portion of the longitudinal bar 169.

The rearward end of the longitudinal bar 169 is formed with a reduced in cross section stub 181 extending therefrom. The rear C-shaped clamp is formed having an upper flange 185, a spacer plate 187 and a lower flange 189. The spacer plate 187 is dimensioned to maintain the upper flange 185 and lower flange 189 apart a distance sufficient to allow the rear C-shaped clamp 183 to be inserted in the rearward extremity of the central slot 173 and to snugly encompass the depth of the fuselage and thereby be securely maintained in place. The central portion of the upper flange 185 and the upper central portion of the spacer plate 187 has an upwardly and forwardly cutaway portion defining a mounting slot 191 configured to receive the stub 181 therein.

In practice the forward end of the track 169 is mounted to the back side of the front clamp 175 and the sleeve 165 telescoped longitudinally onto such track from the back end thereof. The rearward C-clamp may be installed in the aft extremity of the central slot 173. The forward C-shaped clamp may then be inserted into the central slot 173, and moved all the way forward so that the C-shaped clamp snugly receives the depth of the fuselage therein. (It will be appreciated that there is sufficient flexture in the fuselage body to permit the rear extremity of the track 169 to remain elevated during this operation.) Such rear extremity may then be lowered to nest the stub in the cutaway slot 191 and clearance slot 192. The longitudinal bar 169 is thereby secured in the central slot 173 with the rearwardly facing shoulder around the stub acting to hold the rear C-clamp 183 in place. The remainder of the plane is then assembled as described above and is ready for operation.

Although one specific embodiment of the invention and one alternative method of slidably capturing the sliding post has been described and illustrated, the invention is not to be limited to the specific forms and arrangement of parts so described and illustrated, and various modifications and changes thereto can be made without departing from the scope and spirit of the invention. Within the scope of the appended claims, therefore, the invention may be practised otherwise than as specifically described and illustrated herein.

Having thus described the invention, I claim:

1. A variable swept wing toy glider comprising:

a wide body horizontally disposed, elongated fuselage formed in its midsection with a longitudinally elongated slot and further formed with oppositely disposed, horizontal, outboard wing support surfaces:

track means in said slot;

a pair of symmetrical elongated wings formed with inboard bearing surfaces disposed in opposed relationship to said support surfaces;

pivot pins pivotally connecting said wings to said fuselage;

biasing means to bias the outboard ends of said wings forwardly to respective extended positions;

a pair of drive pins mounted on said wings at a location inboard and rearward of the respective pivot pins;

slider means received in said track means and including laterally projecting drive plate means engaging behind said drive pins and including a downwardly projecting launch hook projecting beneath said fuselage whereby a slingshot type launcher may be connected with said launch hook and actuated to draw said launch hook and slider forwardly in said track means to move said drive plate means forwardly to drive said drive pins forwardly to rotate said wings about the respective pivot pins to overcome the bias of said bias means and retract said wings to their retracted position such that release of said launcher to propel said glider forwardly to an aloft position will free said launch hook and slider such that, as the velocity of said glider slows as it reaches the apex of its flight, the forces holding the wings back in their swept back configuration will be reduced sufficiently to allow the force of said bias means to overcome such forces and allow said bias means to rotate said wings about the respective pivot pins to rotate them forwardly to an extended position.

2. A toy glider as in claim 1 further comprising:

a biasing anchor pin means mounted on said fuselage and disposed forward of said pivot pins;

said biasing means is an elastic band hooked over said anchor pin means and coupled on its opposite ends with the respective wings

3. A toy glider as set forth in claim 2 wherein:

said wings include bias actuating posts disposed forwardly of said pivot pins; and said bias means is in the form of a rubber band stretched between said bias actuating posts.

4. A toy glider as set forth in claim 1 wherein:

said fuselage includes a pair of longitudinal runners projecting downwardly beyond the lower extent of said launch hook.

5. A toy glider as set forth in claim 1 wherein:

said fuselage is formed with said wing support surfaces facing upwardly;

said bearing surfaces are formed on said wings to face downwardly to overlie the respective upwardly facing support surfaces;

said slot is formed to extend vertically through said fuselage;

said track means is formed with a track defining a vertical through passage;

said slider is received in said passage; and said drive plate means is mounted on said slider on the upper side of said fuselage.

6. A toy glider as set forth in claim 1 wherein:

a pair of rotation plates are interposed between the support surfaces and said bearing surfaces, said rotation plates being formed with through bores for projection of said pivot pins, each said rotation plate including a projecting fastener tang; and said wings are formed with respective pivot bores for passage of the respective pivot pins and respective open ended slots for receipt of the respective tangs.

7. A toy glider as set forth in claim 5 wherein:

said track means includes a pair of laterally spaced apart rails formed therebetween with a longitudinal passage defining a vertically through passage; and said slider means includes a T-fitting having one flange thereof received in said passage.

8. A toy glider as set forth in claim 7 that includes:

a C-shaped mounting bracket for insertion in the aft end of said slot, said bracket being configured with top and bottom horizontal flanges spaced vertically apart a distance sufficient to receive therebetween the thickness of said fuselage at the aft end of said slot, said top flange being formed with tines defining horizontally spaced apart retaining lips defining therebetween a forwardly opening passage for receipt of the aft extremity of said rails.

9. A toy glider as in claim 8 further comprising:

an adjustment cam having a cam stem and a cam disc mounted atop said cam stem;

said C-shaped mounting bracket defining a bore through said top flange, said bore located between said tines and being configured for rotatably receiving therein said cam stem.

10. A toy glider as in claim 1 further comprising:

said track means including an elongate bar; and said slider means being a sleeve slidably surrounding said elongate bar.

11. A toy glider as set forth in claim 10 wherein:

said fuselage is formed with said slot extending vertically therethrough;

said track means includes a forwardly opening C-clamp mounted at the front of said bar and configured to receive the thickness of said fuselage at the front end of said slot, said bar being formed at its back extremity with a stub section; and an aft C-clamp opening rearwardly and configured to receive the thickness of said fuselage at the back end of said slot, said aft C-clamp being formed with an upwardly and forwardly opening slot configured to receive therein said stub section.

* * * * *